US006574342B1

(12) United States Patent
Davis et al.

(10) Patent No.: US 6,574,342 B1
(45) **Date of Patent: *Jun. 3, 2003**

(54) HEARING AID FITTING SYSTEM

(75) Inventors: Keith L. Davis, Salt Lake City, UT (US); Xiaoling Fang, Draper, UT (US); Darrell Rose, Orem, UT (US); Douglas M. Chabries, Orem, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/500,392

(22) Filed: Feb. 8, 2000

Related U.S. Application Data

(62) Division of application No. 09/040,503, filed on Mar. 17, 1998.

(51) Int. Cl.[7] ..... H04R 25/00

(52) U.S. Cl. ..... 381/314; 381/60; 381/321

(58) Field of Search ..... 381/312, 314, 381/320, 321, 323, FOR 127, FOR 129, FOR 131, 60; 128/246; 73/585; 600/559

(56) References Cited

U.S. PATENT DOCUMENTS

| | | | | |
|---|---|---|---|---|
| 3,718,763 | A | 2/1973 | Cannon et al. | 179/1 |
| 3,793,485 | A | 2/1974 | Freezor et al. | 179/1 |
| 3,848,091 | A | 11/1974 | Stearns et al. | 179/1 |
| 3,927,279 | A | 12/1975 | Nakamura et al. | 179/107 |
| 3,989,904 | A | 11/1976 | Rohrer et al. | 179/107 |
| 4,099,035 | A | 7/1978 | Yanick | 179/107 |
| 4,107,465 | A | 8/1978 | Charlebois et al. | 179/1 |
| 4,109,106 | A | 8/1978 | Voss | 179/1 |
| 4,118,604 | A | 10/1978 | Yanick | 179/107 |
| 4,157,456 | A | 6/1979 | Voss | 179/1 |
| 4,170,720 | A | 10/1979 | Killion | 179/107 |
| 4,222,393 | A | 9/1980 | Hocks et al. | 128/746 |
| 4,321,427 | A | 3/1982 | Singh | 179/1 |
| 4,403,118 | A | 9/1983 | Zollner et al. | 179/107 |
| 4,471,171 | A | 9/1984 | Köpke | 179/107 |
| 4,489,610 | A | 12/1984 | Slavin | 73/585 |
| 4,548,082 | A | 10/1985 | Engebretson et al. | 73/585 |
| 4,596,902 | A | 6/1986 | Gilman | 179/107 |
| 4,603,324 | A | 7/1986 | Hu | 340/384 |
| 4,622,440 | A | 11/1986 | Slavin | 381/68.1 |
| 4,677,679 | A | 6/1987 | Killion | 381/74 |
| 4,696,032 | A | 9/1987 | Levy | 379/390 |
| 4,731,850 | A | 3/1988 | Levitt et al. | 381/68.2 |
| 4,759,070 | A | 7/1988 | Voroba et al. | 381/60 |
| 4,768,165 | A | 8/1988 | Hohn | 364/900 |
| 4,773,088 | A | 9/1988 | Matheny | 379/395 |
| 4,790,019 | A | 12/1988 | Hueber | 381/68.4 |
| 4,792,977 | A | 12/1988 | Anderson et al. | 381/68.4 |
| 4,829,270 | A | 5/1989 | Anderson et al. | 333/14 |
| 4,845,755 | A | 7/1989 | Busch et al. | 381/68 |
| 4,879,749 | A | 11/1989 | Levitt et al. | 381/68.4 |
| 4,882,762 | A | 11/1989 | Waldhauer | 381/106 |
| 4,887,299 | A | 12/1989 | Cummins et al. | 381/68.4 |
| 4,901,353 | A | 2/1990 | Widin | 381/68 |

(List continued on next page.)

FOREIGN PATENT DOCUMENTS

| | | | |
|---|---|---|---|
| EP | 0 341 903 | 11/1989 | H04R/25/00 |
| EP | 0 714 067 | 5/1996 | G06F/13/38 |
| EP | 0 823 829 | 2/1998 | H04R/25/00 |
| WO | WO 99/26453 | 5/1999 | H04R/25/00 |

*Primary Examiner*—Huyen Le
(74) *Attorney, Agent, or Firm*—Thelen Reid & Priest LLP; David B. Ritchie

(57) ABSTRACT

A method for fitting a hearing compensation device comprises selecting a plurality of loudness levels for a plurality of frequencies and comparing each loudness level for each frequency for perceived sameness. The loudness levels may then be adjusted as needed to achieve perceived sameness across the frequency spectrum. A gain curve for each frequency is calculated from the selected plurality of loudness levels.

20 Claims, 6 Drawing Sheets

U.S. PATENT DOCUMENTS

| | | | | |
|---|---|---|---|---|
| 4,941,179 | A | | 7/1990 | Bergenstoff et al. ..... 381/68.4 |
| 4,947,432 | A | | 8/1990 | Tøpholm ..... 381/68.2 |
| 4,947,433 | A | | 8/1990 | Gebert ..... 381/68 |
| 4,953,112 | A | | 8/1990 | Widin et al. ..... 364/578 |
| 4,972,487 | A | | 11/1990 | Mangold et al. ..... 381/68 |
| 4,992,966 | A | | 2/1991 | Widin et al. ..... 364/571.04 |
| 4,996,712 | A | | 2/1991 | Laurence et al. ..... 381/68.4 |
| 5,007,090 | A | | 4/1991 | Bransky et al. ..... 381/60 |
| 5,081,441 | A | | 1/1992 | Chojar ..... 340/384 |
| 5,083,312 | A | | 1/1992 | Newton et al. ..... 381/68.4 |
| 5,144,674 | A | | 9/1992 | Meyer et al. ..... 381/68 |
| 5,202,927 | A | | 4/1993 | Tøpholm ..... 381/68 |
| 5,210,803 | A | | 5/1993 | Martin et al. ..... 381/68 |
| 5,266,919 | A | | 11/1993 | Cook et al. ..... 340/384 |
| 5,278,912 | A | | 1/1994 | Waldhauer ..... 381/68.4 |
| 5,303,306 | A | | 4/1994 | Brillhart et al. ..... 381/68 |
| 5,384,852 | A | | 1/1995 | Schären ..... 381/68 |
| 5,386,475 | A | | 1/1995 | Birck et al. ..... 381/68 |
| 5,406,633 | A | | 4/1995 | Miller et al. ..... 381/68.4 |
| RE34,961 | E | | 6/1995 | Widin et al. ..... 364/578 |
| 5,488,668 | A | | 1/1996 | Waldhauer ..... 381/68.4 |
| 5,495,242 | A | | 2/1996 | Kick et al. ..... 340/902 |
| 5,524,056 | A | | 6/1996 | Killion et al. ..... 381/68.2 |
| 5,710,819 | A | | 1/1998 | Tøpholm et al. ..... 381/68.2 |
| 5,835,611 | A | * | 11/1998 | Kaiser ..... 381/321 |
| 5,838,801 | A | | 11/1998 | Ishige et al. ..... 381/68.4 |
| 5,867,581 | A | | 2/1999 | Obara ..... 381/312 |
| 5,910,997 | A | | 6/1999 | Ishige et al. ..... 381/314 |
| 6,023,517 | A | | 2/2000 | Ishige ..... 381/315 |
| 6,035,050 | A | | 3/2000 | Weinfurtner et al. ..... 381/313 |
| 6,058,197 | A | | 5/2000 | Delage ..... 381/314 |

* cited by examiner

Tone Generation Table

| Tone Frequency(Hz) | 500 | 755 | 1000 | 1500 | 2000 | 3000 | 4000 | 6000 | 8000 |
|---|---|---|---|---|---|---|---|---|---|
| Number of Cycles | 1 | 2 | 2 | 3 | 4 | 6 | 8 | 12 | 16 |
| Number of Samples | 40 | 53 | 40 | 40 | 40 | 40 | 40 | 40 | 40 |

HEARING AID FITTING SYSTEM

This application is a division of application Ser. No. 09/040,503 filed Mar. 17, 1998.

BACKGROUND OF THE INVENTION

1. Field of the Invention

The present invention relates to hearing-aid fitting systems. More particularly, the present invention relates to a hearing-aid fitting system for a programmable hearing-aid device wherein the programmable hearing-aid device to be worn by the hearing-aid user is employed in the assessment of the hearing loss of the individual.

2. The Prior Art

In well-known methods of acoustically fitting a hearing compensation device A such as a hearing-aid to an individual, the threshold of the individual's hearing is typically measured using a calibrated sound-stimulus-producing device and calibrated headphones. The measurement of the threshold of hearing takes place in an isolated sound room, usually a room where there is very little audible noise. The sound-stimulus-producing device and the calibrated headphones used in the testing are known in the art as an audiometer.

Generally, the audiometer generates pure tones at various frequencies between 125 Hz and 12,000 Hz that are representative of the frequency bands the tones are included in. These tones are transmitted through the headphones of the audiometer to the individual being tested. The intensity or volume of the pure tones is varied until the individual can just barely detect the presence of the tone. For each pure tone, the intensity of the tone at which the individual can just barely detect the presence of the tone, is known as the individual's air conduction threshold of hearing. Although the threshold of hearing is only one element among several that characterizes an individual's hearing loss, it is the predominant measure traditionally used to acoustically fit a hearing compensation device.

Once the threshold of hearing in each frequency band has been determined, this threshold is used to estimate the amount of amplification, compression, and/or other adjustment that will be employed to compensate for the individual's loss of hearing. The implementation of the amplification, compression, and/or other adjustments and the hearing compensation achieved thereby depends upon the hearing compensation device being employed. There are various formulas known in the art which have been used to estimate the acoustic parameters based upon the observed threshold of hearing. These include industry hearing compensation device formulas known as NAL1, NAL2, and POGO. There are also various proprietary methods used by various hearing-aid manufacturers. Additionally, based upon the experience of the person performing the testing and the fitting of the hearing-aid to the individual, these various formulas may be adjusted.

In another method for fitting a hearing-aid using an audiometer, more than just the hearing threshold measurement in each audio band is employed to calibrate the hearing-aid to compensate for an individual's hearing loss. In this method, known as loudness growth by octave band (LGOB), tones at various frequencies and of various intensities are presented at random to the individual being tested through the earphones of the audiometer. Each of the tones is then characterized by the person being tested according to the individual's perception of loudness. For these measurements, a seven point scale is employed for each of the various frequency bands.

There are a number of substantial problems associated with each of these prior art methods for fitting a hearing-aid device. Some of these problems are due to the methodology employed to assess the hearing compensation required, some are due to the equipment used to perform the testing, and some are due to the manner in which the testing is performed.

For example, the hearing compensation assessment methodologies do not provide any manner of accurately comparing a series of tones covering the frequency spectrum to determine whether there is an equal perceived loudness for the tones across the frequency spectrum. In other words, these methodologies lack the facility to accurately assess whether a sound perceived as soft, medium or loud is equally perceived as soft, medium or loud across the frequency. Another problem arises from the known hearing compensation methodologies, because the formulas for estimating the hearing compensation from the tested hearing loss employ broad averages as a baseline that do not take into account the perceptual differences among the individuals being tested.

Further, when the audiometer apparatus includes earphones to supply the tones to an individual being tested, it is difficult to calibrate the output of the hearing-aid device to be worn by the individual to match the output of the headphones which were used to measure the hearing loss. Another problem associated with the use of headphones to present tones to the individual is that due to the unique acoustics of each individual's ear canal, the acoustic response and therefore the perception by the individual of the sound provided by the headphones will be different from the perception of sound when the actual hearing-aid device is inserted into the ear canal.

Finally, once the hearing compensation provided by the hearing-aid has been set, and the hearing-aid has been inserted into the ear canal of the individual, the testing methods do not provide any satisfactory manner of performing an instantaneous comparison between a first fitting and a second fitting. This is known as A–B comparison. Typically, the amount of time required to perform an A–B comparison is either the amount of time needed to remove a device A and insert a second device B, or the 20 plus seconds required to update the programmed hearing compensation in a programmable hearing aid. This makes it difficult for an individual to accurately compare perceived differences in loudness in response to stimuli for the alternate fittings.

Accordingly, it should be appreciated that there is a need for a simple and accurate method of assessing the hearing loss of an individual to provide a successful fitting of a multi-band, broad dynamic range, programmable hearing compensation devices.

Further, it is an object of the present invention to measure the perception of loudness of an individual at multiple levels in each frequency band and to compare perceived loudness across a frequency bands for different dynamic levels.

Another object of the present invention to assess the hearing loss of individual by employing the hearing aid to be worn by the individual to generate the tones used to assess the hearing loss.

It is another object of the present invention to compensate for a variation in the electrical characteristics of the components employed in a hearing aid.

It is a further object of the present invention to simplify and make more accurate the comparison of alternate hearing compensation implementations in a programmable hearing aid.

BRIEF DESCRIPTION OF THE INVENTION

A method for fitting a hearing compensation device according to the present invention comprises selecting a plurality of loudness levels for a plurality of frequencies and comparing each loudness level for each frequency for perceived sameness. The loudness levels may then be adjusted as needed to achieve perceived sameness across the frequency spectrum. A gain curve for each frequency is calculated from the selected plurality of loudness levels.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

In a hearing aid fitting system according to the present invention, an assessment of the hearing loss of an individual across a broad dynamic range in multiple frequency bands to ensure a proper fit of a hearing aid to the individual is made very simply and accurately. In the present invention, the tones presented to the individual in the hearing loss assessment are generated by the hearing aid. Accordingly, unlike prior art fitting systems, the tones used in hearing assessment match the output of the hearing aid, and the in-the-ear acoustics are the same for both the apparatus used in assessing the hearing loss and the hearing aid. The tones are generated in response to the manipulation of a graphical user interface by the individual which makes it easy for the individual to assess a plurality of dynamic levels in each frequency band, to compare the same dynamic level across a spectrum of frequency bands, to adjust the hearing compensation to account for individual perceptual differences, and to compare alternative fittings.

Figure 1:
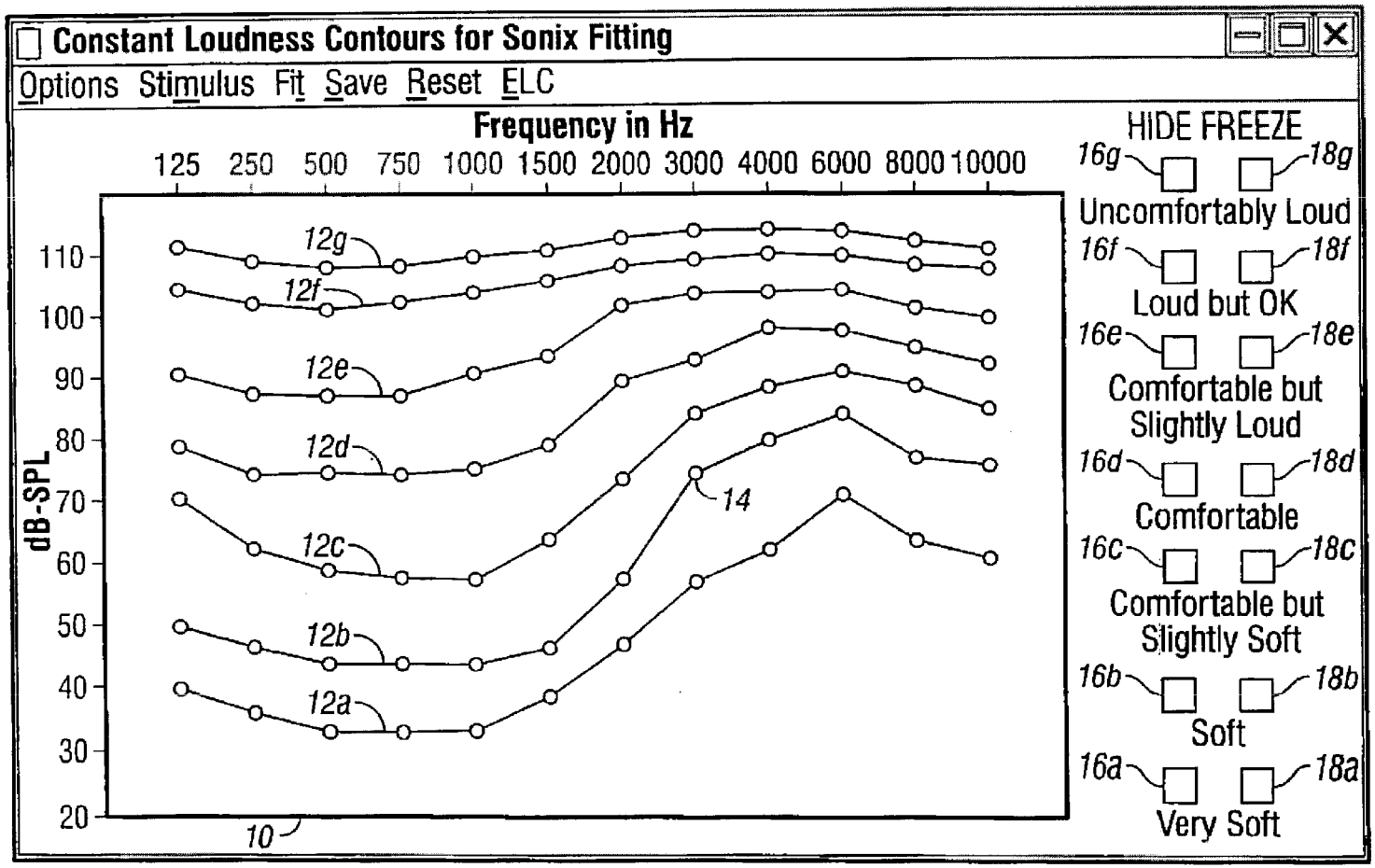
FIG. 1 illustrates a portion of a graphical user interface depicting perceived loudness curves for use according to the present invention.

Turning now to FIG. 1, a perceived loudness interface 10 comprising a portion of the graphical user interface according to the present invention for adjusting the perceived loudness of the tones presented to an individual in the hearing assessment process for a plurality of frequency bands is illustrated. In the perceived loudness interface 10, loudness curves 12 representing various loudness levels are displayed on a graph with a horizontal axis representing frequency in Hertz, and the vertical axis representing loudness in decibels. Each of loudness curves 12 indicate a perceived level of loudness, from very soft to uncomfortably loud, across the entire hearing frequency spectrum. For each of the loudness curves 12, the center frequency in each frequency band is indicated by a marker, one of which is indicated by the reference numeral 14.

By using a mouse, or other suitable computer pointing devices the operation of which are well known, the individual being tested can click on any of the markers 14, and a tone of the frequency and loudness corresponding to the selected marker 14 will be generated by the hearing aid and presented to the individual being tested. The frequency of the tone corresponds to the X axis position of the selected marker 14, and the loudness of the tone corresponds to the Y axis position of the selected marker 14. To adjust the loudness corresponding to one of the markers 14, the individual being tested can click and hold on the selected marker 14, and move it up or down to make the perceived sound either louder or softer.

In assessing the hearing loss of the individual, the individual's task is to evaluate the tone associated with each marker 14 by positioning every marker 14 in each of the loudness curves 12. Each marker 14 on a selected loudness curve 12 should be perceived as having the same dynamic level as each of the other markers 14 on the selected loudness curve 12. As a consequence, perception of loudness will the same across the entire frequency spectrum for the selected loudness curve 12.

In the sample hearing assessment illustrated in FIG. 1, less hearing compensation is required to perceive a soft sound at low frequencies than is required at higher frequencies. Because the individual being tested can quickly and easily move between and click on various markers 14 of a selected loudness curve 12 in the perceived loudness interface 10, the task of determining perceived loudness across the entire frequency spectrum is greatly simplified. Further, the comparison of different dynamic levels in the same frequency band is also made much easier by the loudness perception interface 10 which permits changing almost instantaneously between the dynamic levels associated with the markers 14 for each of the loudness curves 12 in the same frequency band.

As shown in the loudness window of FIG. 1, other functions for each of the loudness curves 12 are also available. Each of the loudness curves 12 can be selected to be hidden from view by hide controls 16 so that only a few test points are taken in each frequency band. Each of the loudness curves 12 may also be selected to be fixed in place by freeze controls 18 so that a particular loudness curve 12 will not inadvertently be adjusted once it has been set.

Figure 2:
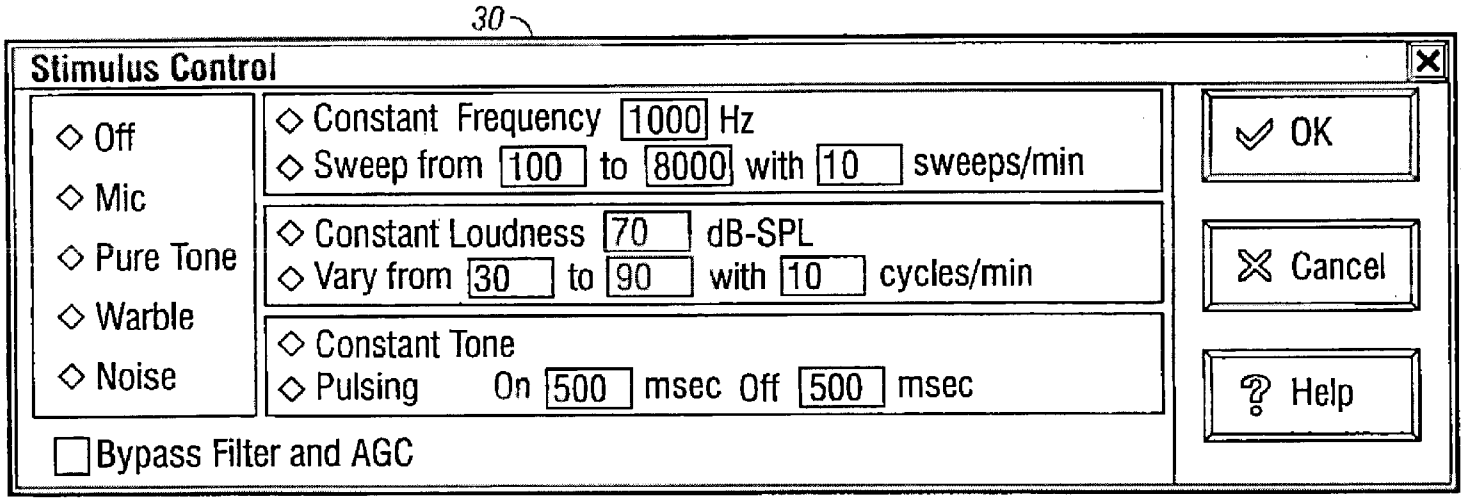
FIG. 2 illustrates a portion of a graphical user interface depicting stimulus control for use according to the present invention.

Several features that may be used to set the loudness curves 12 in FIG. 1 are available in the stimulus control window 30 depicted in FIG. 2. As shown in the stimulus control window 30, the stimulus may either be generated by the hearing aid as a pure tone, or narrow band noise or be input from a microphone in the hearing aid, and that the tone can either be constant or selected to pulse for a desired rate or duty cycle. Those of ordinary skill in the art will appreciate that other types of stimuli not shown in the stimulus control window 30 can also be provided. For example a warble tone or other digital sound files. Further, with regard to both the frequency and loudness of the tone provided, it can be seen that the frequency and/or loudness may be constant or swept between selected frequencies or dynamic levels for a selected interval.

Figure 3:
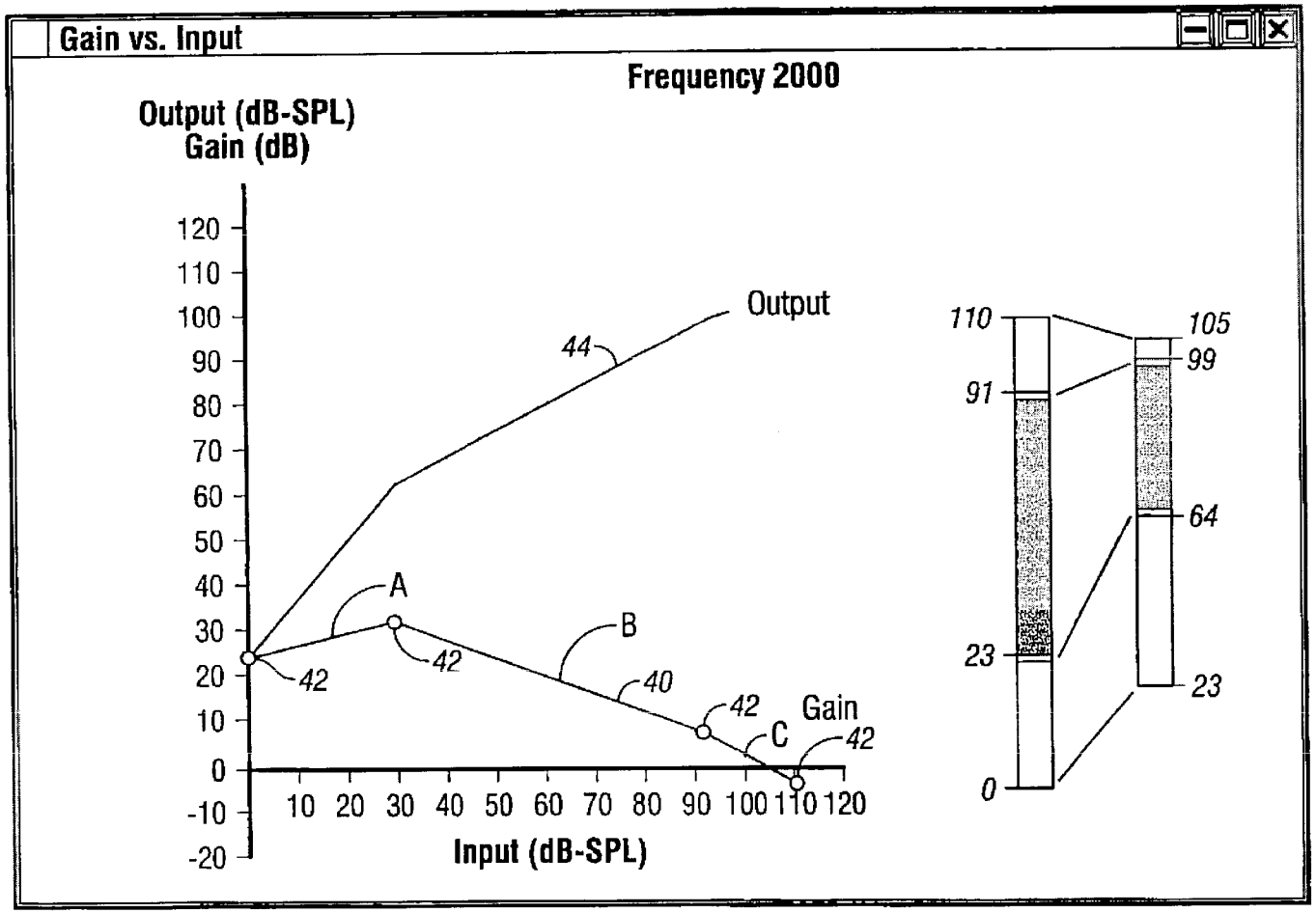
FIG. 3 illustrates a portion of a graphical user interface depicting a hearing compensation curve for use according to the present invention.

As the markers 14 of the loudness curves 12 in the loudness perception interface are set, a hearing compensation curve 40 as illustrated in FIG. 3 for each center frequency in each of the frequency bands is generated. As will be appreciated by those of ordinary skill in the art, the hearing compensation curve 40 for each of the frequency bands can be formed in any of several ways from the data obtained from the loudness curves 12.

In the preferred embodiment of the present invention, each hearing compensation curve 40 has three regions A,B, and C delimited by markers 42. In region A of the hearing compensation curve 40, the hearing aid gain is typically constant or slightly expansive to provide noise suppression at low sound levels. In region B of hearing compensation curve 40 the gain is typically compressive. Region B is typically compressive since it is usually the case that less gain is needed in a particular frequency band as the sound stimulus becomes louder. In region C of hearing compensation curve 40, the gain is typically compression limited. In region C, the gain may not only be limited, it may also in fact reduce the level of the sound stimulus to prevent discomfort to the hearing aid user. The output sound level curve 44 of the hearing aid being presented to the hearing aid user in dB-SPL is also shown in FIG. 3.

In a preferred embodiment of the present invention, the hearing aid used in the fitting system of the present invention, is a multi-band automatic gain control device that employs digital signal processing to provide hearing compensation in each of the selected frequency bands. The data controlling the digital signal processor (DSP) to provide the acoustic response of the hearing aid according to the hearing compensation curves 40 is loaded or programmed into a memory in the hearing aid. The loading of the data into the memory employed by the DSP will explained in greater detail below.

Once the hearing aid has been programmed with the acoustic response estimated to compensate for the patient's hearing loss, the hearing aid microphone is turned on so that the patient will hear ambient sound as processed by the hearing aid. In the gain window illustrated by FIG. 3, the audiologist or individual may now further adjust the hearing compensation curve 40 for any selected frequency band according to the individual's response to ambient sound. The hearing compensation curve 40, and the corresponding output, in response to input stimuli in the selected frequency band, may be adjusted by moving any of the markers 42 to change either the boundary between regions A, B, and C or the gain characteristics in any of these three regions. The acoustic response of the hearing aid changes instantaneously as the hearing compensation curve 40 is adjusted so that the hearing aid user can hear the effect of modifying the hearing compensation curve 40 of a selected frequency band.

Figure 5:
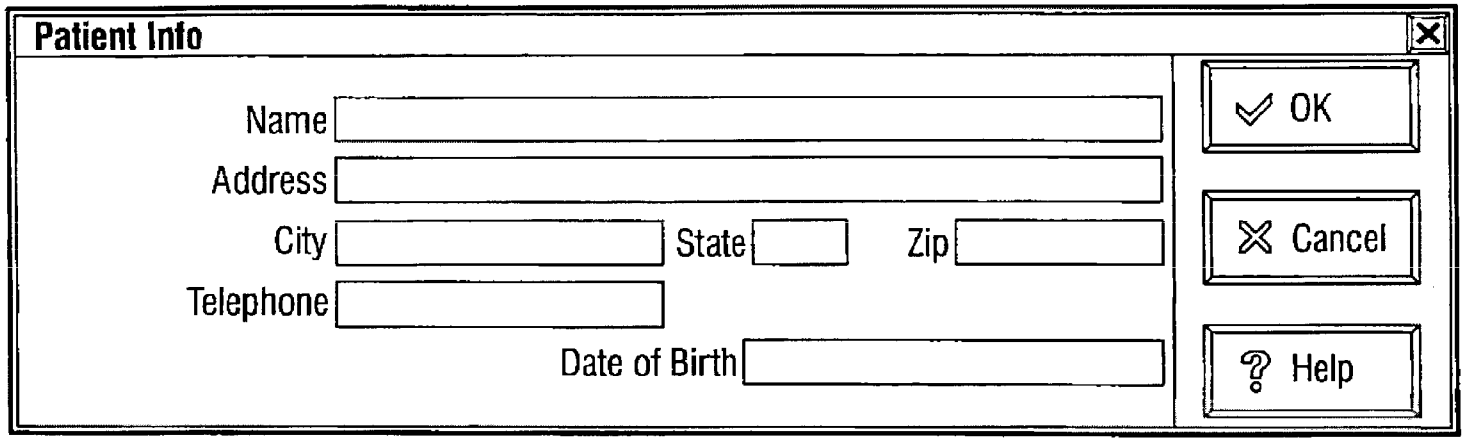
FIG. 5 illustrates a portion of a graphical user interface depicting patient information for use according to the present invention.
Figure 4:
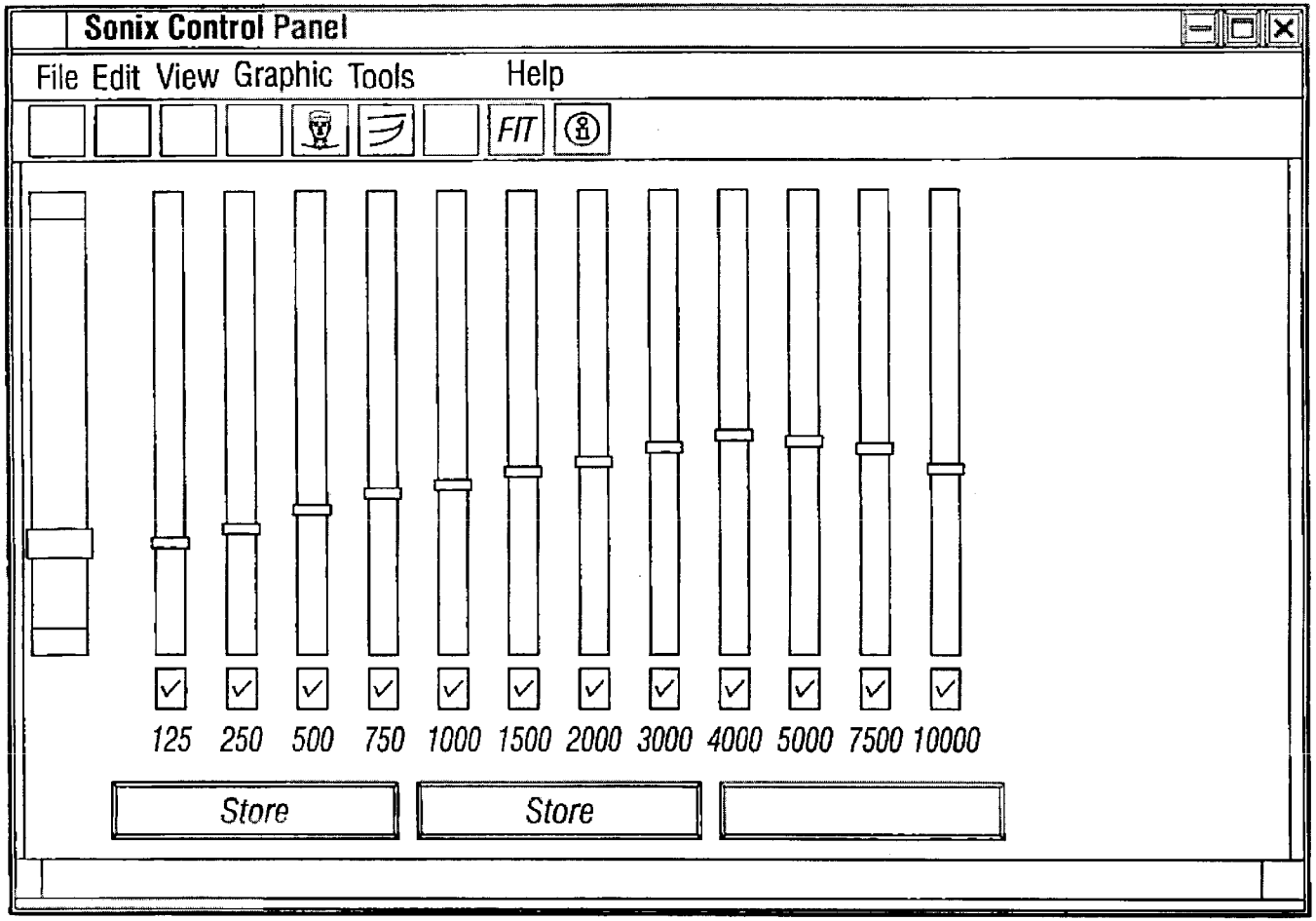
FIG. 4 illustrates a portion of a graphical user interface depicting a control panel for use according to the present invention.

An additional feature of the fitting system of the present invention is depicted in FIG. 4. As shown therein, any subset of the frequency channels can be disabled or enabled at any given time. This is very helpful in isolating unwanted frequencies, feedback, or other sounds that may occur at a specific frequency. Further, as shown in FIG. 4, multiple data sets corresponding to different independent fittings may be stored and loaded into the hearing aid for almost instantaneous comparison between the different fittings. This makes possible the easy comparison of different fitting choices. As shown in FIG. 5, patient information for the hearing aid can also be stored, this information may include the name, address, telephone number, age, date of birth, record of previous fittings, and an audiogram for the hearing aid user.

According to the present invention, as the graphical interface is manipulated by an individual during the fitting of the hearing aid, tones are generated by the hearing aid and presented to the individual for assessment. In a preferred embodiment, a serial interface device known as Madson's electronic HI-PRO device, manufactured by Madson's Electronics will communicate information pertaining to the frequency, volume, and nature of the tone as selected by the individual from the graphical user interface. Although the HI-PRO device is used in the presently preferred embodiment of the invention it should be appreciated by those of ordinary skill in the art that other external sources could be used to drive the hearing aid.

The serial interface is also used to test the various components of the hearing aid following manufacture. To avoid obscuring the present invention, the component testing aspect of the serial interface will not be discussed herein. Further, it should be appreciated by those of ordinary skill in the art that although a serial interface is disclosed herein, a parallel interface is also within the contemplation of the present invention.

Figure 6:
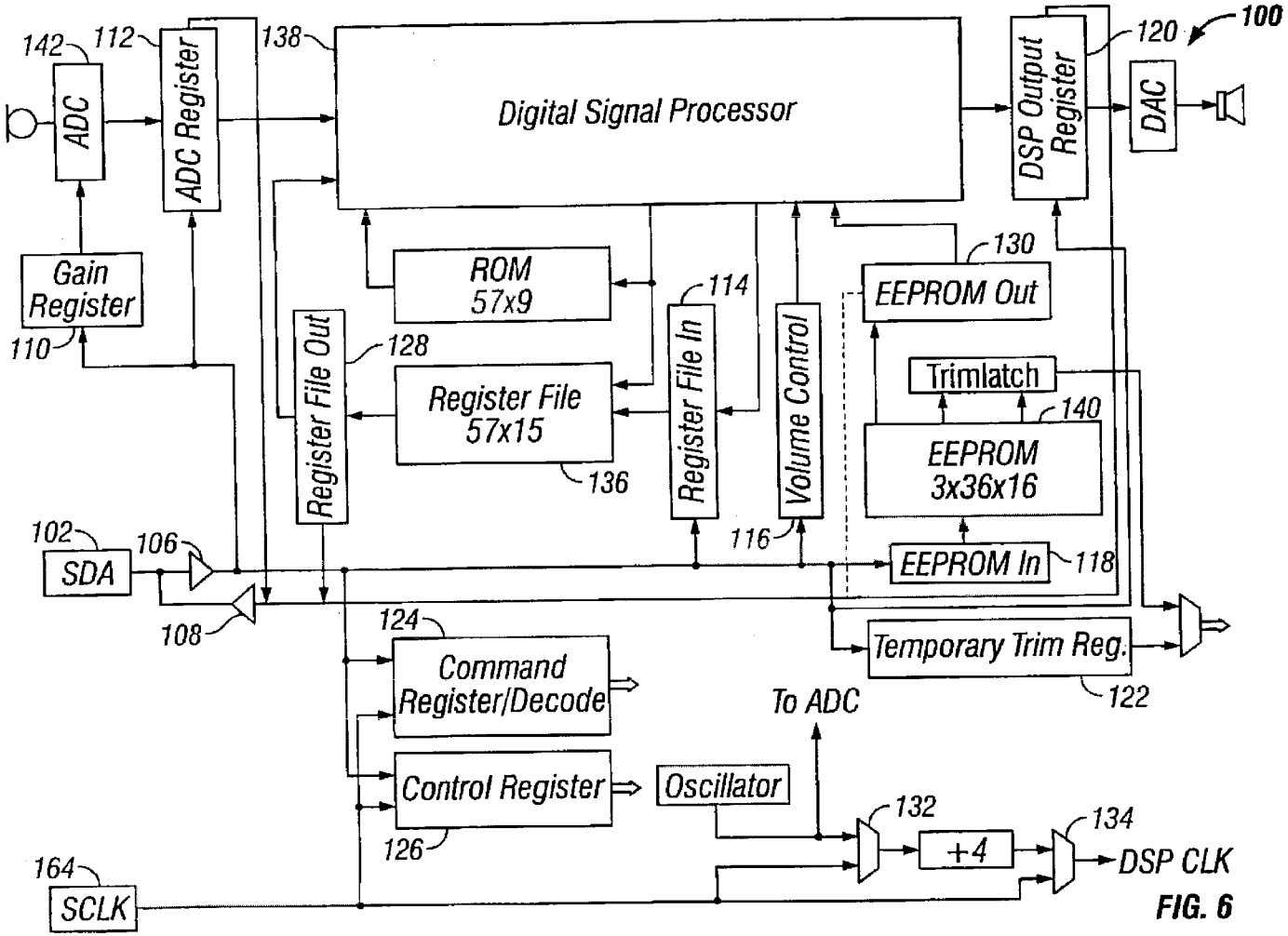
FIG. 6 illustrates a block diagram of the serial interface circuit disposed in the hearing aid according to the present invention.

Turning now to FIG. 6, a block diagram of the hearing aid illustrating a serial interface circuit suitable for use with the fitting system according to the present invention is depicted. The serial interface circuit 100 has three pins, serial data I/O (SDA 102), and serial clock (SCLK 104), and Vdd (not shown) connected to the Hi-Pro device. The SDA 102 and SCLK 104 pins are signal pins, while the Vdd pin provides power to the hearing aid.

In FIG. 6, the SDA 102 is connected to the input of an input buffer 106, and to the output of an output buffer 108. The input buffer 106 is connected to a gain register 110, an analog-to-digital (A/D) register 112, a register file input buffer 114, a volume control 116, an EEPROM input buffer 118, a DSP output register file 120, a temporary trim register file 122, a command register 124, and a control register 126. The output buffer 108 is connected to the A/D register 112, a register file output buffer 128, an EEPROM output register 130, and the DSP output register 120. The SDCLK is connected to the command register 124, the control register 126, a first two-input multiplexer 132, and a second two-input multiplexer 134.

In the serial interface circuit 100, the SDA pin 102 is employed to input a serial data stream including various read and write instructions from the Hi-pro device to the hearing aid employed to program the hearing aid and to output data from various circuits in the serial interface circuit 100 during both testing and in the fitting process to the Hi-Pro device to determine whether the data in these various circuits is as expected. SCLK 104 is used to input a serial clock that clocks in the instructions from the serial data stream input on SDA 102.

The present maximum clock rate from the HI-PRO device to the serial interface circuit 100 is 7 KHZ. It is anticipated however that the serial interface circuit 100 will also interface to other devices such as IC testers, and as a result the SDA 102, and SCLK 104 pins can operate at 1.5 MHZ when receiving data from an external source. The serial interface circuit 100 can drive output through the SDA pin having a 50 pf load at a 500 kHz clock rate.

Figures 7, 8:
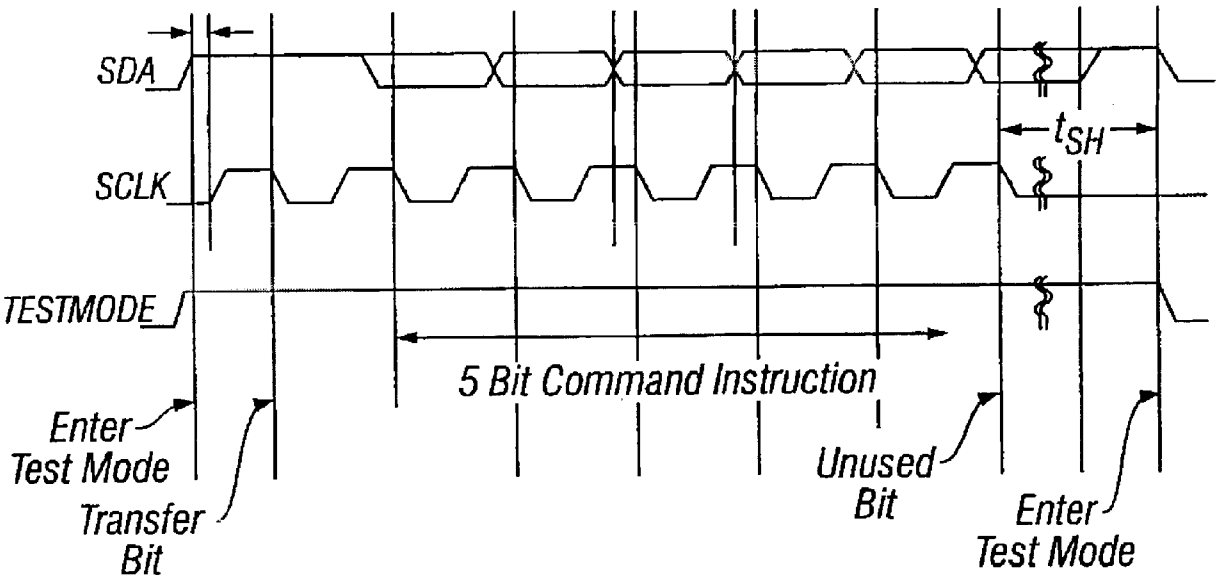
FIG. 7 illustrates an exemplary timing diagram for instructions received through the serial interface circuit according to the present invention.
FIG. 8 is table illustrating the center frequencies of each of the frequency bands and the number of data words required to generate each center frequency according to the present invention.

In FIG. 7, an exemplary timing diagram for the instructions received through the serial interface 100 is illustrated. When the hearing aid is in its typical mode of operation both SDA 102 and SCLK 104 are both held low. When an instruction is input to the hearing aid, a state known as TEST mode, SDA 102 is brought HIGH while SCLK 104 is held LOW. The data stream of the instruction is then input through SDA 102 by toggling the signal to SCLK 104. According to the preferred embodiment, to remain in TEST mode, the data being input on SDA 102 is permitted to only make a transition when the SCLK 104 input is in a HIGH state. This is illustrated in FIG. 7 as $t_{DH}$, the data hold time. The setup time for the SDA 102 transition, shown as $t_{DS}$, is preferably 200 ns prior to the transition from HIGH to LOW of the SCLK 102 input.

Each of the instruction commands is seven bits in length, wherein the leading bit is always a HIGH logic state. Once all of the instruction bits have been toggled in by SCLK 104, the instruction command is decoded by command register decode 124. The instruction set includes both read and write commands. For a write command, once the write command has been decoded, the number of bits to be written associated with the write command decoded will then be shifted in on SDA 102 as SCLK 104 is toggled. The write commands include Write Temporary Trim Register, Write Tone Volume Control Register, Write EEPROM Block "0" or "1", Write Channel Select Register, Write Control Register, Write ADC Register, Write Register File, Write DSP Register, Write EEPROM, Write ADC External Gain.

For a read command SDA 102 will be tristated and the hearing aid will drive the output from the SDA pin 102 on the rising edge of SCLK 104. The hearing aid will count the number of rising edge transitions of SCLK 104, and will terminate the data read when appropriate. The read commands include Read ADC Register, Read Register File, Read DSP Register, and Read EEPROM.

In the assessment of the hearing loss, the instructions from the graphical interface output by the Hi-Pro device include changing the dynamic level of a tone at a particular frequency and or changing the frequency of the tone. When the dynamic level is being changed, the change is implemented by writing a new dynamic level into the volume control register 116.

When a tone at a difference frequency is to be generated, a Write Register File command is implemented to write serial data corresponding to the desired waveform into register file 136. In the preferred embodiment of the present invention, register file 136 is fifty-seven words in length, and each word is fifteen bits wide. Though the register file 136 is used during ordinary operation of the DSP 138, the state machine that controls the DSP 138 will read the register file 136 during TEST mode at a rate of 1 word per 50 $\mu$s to generate the desired tones. The tones being generated in each of the frequency bands and the number of words used to implement each of these tones is illustrated in table 1 shown in FIG. 8. It should be appreciated that after the number of words, according to table 1, needed to generate the desired tone have been read, the sequencer in the DSP 138 will loop back to the beginning of the register file 136, unit instructed to stop.

The register file 136 has only fifty-seven words, however, the HI-PRO device used in the preferred embodiment will write for 64 cycles to the register file 136. Despite the fact that the HI-PRO will send clocking and data as though all sixty-four words are present in the register file 136, some address locations are not written. In writing data to register file 136, a word of data from the serial data input stream is first written into the register file input register 114 and then clocked in the register file 136 with the next four SCLK cycles. Accordingly, after the Write register File command, a total of twenty SCLK cycles are required for each data word written into the register file 136. The data in the serial data stream is written into sequential memory locations in the register file 136, with the first word of data being written into the first memory location of register file 136.

The Write control register command is employed to write data into the eighteen bit control register 126. The eighteen bits of the control register 118 direct various functions of the hearing aid, including some of the circuits employed in the fitting system. Bit 0 is not used. Bit 1 is used as clock resource. Bits 2 and 3 determines which portion of the EEPROM, as will be described below, is addressed during test modes. Bit 4 can be set so that the DSP will perform only one cycle and then halt. Bit 5 is used to reset various circuitry in the hearing aid. Bit 6 is used in tone generation. When bit 6 is "1", the DSP 138 will read the first fifty-three words to generate tones, and when bit 6 is "0", the DSP 138 will read the first forty words to generate tones. Bit 7 indicates to whether the hearing aid will operate under normally or whether tones will be generated from the data in the register file 136. If bit 7 is "0" then the DSP 138 will execute the hearing aid algorithm, and when bit 7 is a "1", then the DSP 138 will generate a tone from the data in the RAM 110. Bit 8 is a random noise select for either a programmed amplification of the microphone input or a pseudo random noise source inside the hearing aid. When bit 8 is set to a "1", the random noise source is selected, and when bit 8 is set to a "0" the microphone is selected as a source. Bit 9 selects whether the AGC circuitry in the DSP 138 or the volume control register 116 will set the volume of the output audio signal. When bit 9 is a "1" the volume control register 116 will set the volume, and when bit 9 is a "0" the volume will be set by the AGC circuitry of the DSP 138, it is an ADC disable. Bit 10 is a disable for the A/D output. When the 10 is a "1" the data from the ADC 142 will not be loaded into the ADC register 112. Bit 11 disables the DSP output. When bit 11 is a "1", data from the DSP 138 is not loaded into the DSP output register 120. This allows the DAC 144 to be tested by data sent through the serial I/O circuit 100. Bit 12 enables the DSP operation. When bit 12 is high and the serial I/O circuit 100 is operating, the DSP 138 will be operational using an internal clock. When control bit 12 is a "0", however, the DSP 138 will cease operation whenever the hearing aid is in a TEST mode. Bit 13 is a trim bit selection. When control bit 13 is a "1", the trim bits are supplied by the temporary trim bit register 122. Bit 14 is an enable for the SYNC drive. When bit 14 is a "1", the SYNC pin output is driven with either the channel "1" signal or the compare bit, and when bit 14 is a "0", the SYNC output is held low. Bit 15 is a SYNC selection bit. The hearing aid has an extra pad that is available at wafer sort and characterization called SYNC. This signal can be used to synchronize external operations such as a tester with what is going on inside the hearing aid. Whenever this bit is a zero, the SYNC drive will be driven from the channel counter (channel "1" timing signal). When bit 15 is a "1", the SYNC dry will be driven from the CMP of the A-D converter. If bit 14 is a "0", the output is held at ground. Bit 16 controls the external ADC gain register. When control bit 16 is a "0", the ADC gain is set by circuitry associated with the DSP 138. When control bit 16 is a "1", the ADC 142 gain is set by the gain register 110. Bit 17 is a transfer flag. This bit causes the other seven bits and the control word to be latched and remain valid until written at a later time.

Once the loudness curves 112 have been set by the hearing aid user, the hearing aid can be programmed with the loudness curves 112 for each of the frequency bands in the hearing aid. The Hi-PRO device outputs the instructions and data to the serial interface to program the EEPROM 140 with the data needed to configure the DSP 138 with the desired acoustic response. In the preferred embodiment of the present invention, the EEPROM 140 is partitioned into three groups of thirty-six 16-bit words. The programming instruction for a particular EEPROM 140 will be well known to those of ordinary skill in the art for the particular EEPROM 140 employed.

It should be further appreciated according to the preferred embodiment that separate instructions transmitted to the serial interface circuit 100 allow any of the three groups of thirty-six 16-bit words to be cleared and then written into. The selection of the group of thirty-six 16-bit word will depend upon the status of bits 2 and 3 in the control register 126.

It is contemplated that the upper thirty-six words of the EEPROM 140 can be written to for a variety of uses. A great deal of identifying information for the hearing aid including the user, the dispenser, the production lot, the fabrication lot, etc. can be stored in these upper thirty-six words, and can be read during fitting or can be used for tracking when the device is returned from the field. Further, the EEPROM 140 can store the gain characteristics of the microphone and receiver of the hearing aid for each of the different frequency bands. The amplification data on microphone and receiver would be written into the EEPROM 140 by the final test program, only to be read by the fitting program. During the fitting system the gain constants could automatically be adjusted to compensate for any slight variation in these devices.

According to the present invention, many of the problems associated with the prior art hearing aids have been overcome. The problems associated with calibrating the output of the hearing compensation device to match the output of the headphones or earphones used to measure the hearing loss have been eliminated by using the hearing aid to generate the tones used in measuring the fit. Further by using the hearing aid to generate the tones the unique characteristics of the acoustics of an individual's ear have been accounted for. Further according to the fitting system of the present invention the equal perceived loudness across the frequency spectrum can be obtained with an easy to use graphical interface depicting the loudness curves, further using the graphical interface a quick and easy comparison among various settings can be made. Finally, instead of using formulas to estimate the hearing compensation device acoustic parameters, several measurements are taken in each frequency band to provide a well defined hearing compensation curve for a broad dynamic range in each frequency band.

With this system the sound pressure levels required to reproduce normal loudness for an impaired listener across the range from very soft to very loud is recorded at each frequency. From this loudness data, an acoustic response can be estimated or mapped, and programmed into the hearing compensation device. Enhancements and adjustments to the acoustic response can be made by adjusting points on a graph of the gain function in each frequency band shown on the systems graphical user interface. Once an optimum fit has been found, the defining parameters of that fit determine the output characteristics of the hearing compensation device and the acoustics fittings process is complete.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A hearing aid fitting system comprising:

a stimulus generating device for generating a set of audio stimuli comprising a plurality of loudness levels for each of a plurality of selected frequencies, wherein said stimilus generating device is worn by an individual being fitted and a perceived response of the individual to each said audio stimulus can be determined;

an automatic gain control device for determining a plurality of gain compensation factors for said plurality of loudness levels at said plurality of selected frequencies and for adjusting said plurality of gain compensation factors each corresponding to one of said selected frequencies or to one of said audio stimuli to achieve a substantially similar perceived loudness across the entire frequency spectrum;

a loudness interface having a graphical user interface wherein a gain compensation curve to indicate the measure of gain compensation required by the individual can be plotted and an interconnection between said loudness interface, said automatic gain control device and said stimulus generating device.

2. The system according to claim 1, wherein said graphical user interface is capable of being manipulated for a plurality of frequency bands to measure the hearing loss of the individual.

3. The system according to claim 2, wherein the manipulation of the graphical user interface produces audio stimuli of varying frequencies and intensities.

4. The system according to claim 1, wherein the generation of said audio stimuli enables assessment of a plurality of dynamic levels in each frequency band and the comparison of said dynamic levels across a spectrum of frequency bands.

5. An apparatus for fitting a hearing aid device to an individual apparatus comprising:

means for providing a set of stimuli comprising a plurality of loudness levels for each of a plurality of selected frequencies;

means for determining a perceived response of the individual to each said stimulus;

means for determining a plurality of gain compensation factors for said plurality of loudness levels at said plurality of frequencies;

means for adjusting said plurality of gain compensation factors each corresponding of said frequencies or one of said stimuli to achieve a substantially similar perceived loudness across the entire frequency spectrum; and means for plotting a gain compensation curve to indicate the measure of gain compensation required by the individual.

6. The apparatus according to claim 5, wherein each of the said plurality of loudness levels is represented as a loudness curve on a perceived loudness interface.

7. The apparatus according to claim 6, wherein the center frequency in each frequency band for each of the loudness levels is indicated by a marker.

8. The apparatus according to claim 7, wherein a computer pointing device can be used to select any of the markers.

9. The apparatus according to claim 8, wherein the selection of any of the markers generate a stimulus having a frequency and loudness level corresponding to the selected marker.

10. The apparatus according to claim 9, wherein said stimulus is generated by the hearing aid upon receiving a command via a serial interface.

11. The apparatus according to claim 9, wherein the frequency of the stimulus corresponds to the X axis position of the selected marker and the loudness of the stimulus corresponds to the Y axis position of the selected marker.

12. The apparatus according to claim 9, wherein the loudness of the stimulus corresponding to one of the markers can be adjusted to make the perceived sound either louder or softer.

13. The apparatus according to claim 9, wherein each marker on a selected loudness curve is perceived as having the same loudness level as each of the other markers on the selected loudness curve.

14. The apparatus according to claim 9, wherein the perception of loudness by the individual at multiple levels is measured and compared with perceived loudness across frequency bands for different dynamic levels.

15. The apparatus according to claim 9, wherein each of said loudness curves can also be selected to be fixed in place by freeze controls.

16. The apparatus according to claim 6, wherein a hearing compensation curve can be formed for each of the frequency bands from data obtained from said loudness curves.

17. The apparatus according to claim 5, wherein said loudness levels range from very soft to uncomfortably loud across the entire hearing frequency spectrum.

18. The apparatus according to claim 5, wherein the hearing loss of the individual is assessed by the tones generated by the fearing aid to be worn by the individual.

19. The apparatus according to claim 5, wherein said gain compensation curve has a plurality of regions each of said regions denoting a hearing aid gain function.

20. An apparatus for fitting a hearing aid device to an individual, the apparatus comprising:

means for providing a set of stimuli comprising a plurality of loudness levels for each of a plurality of selected frequencies;

means for determining a perceived response of the individual to each stimulus;

means for determining a plurality of gain compensation factors for said plurality of loudness levels at said plurality of frequencies, wherein the center frequency band for each of the loudness levels is indicated by a marker and a computer pointing device can be used to select any of the makers and wherein selection of any of the makers by the individual generates a stimulus having a frequency and loudness level corresponding to the selected maker;

means for adjusting said plurality of gain compensation factors each corresponding to one of said frequencies or one of said stimuli to achieve a same perceived loudness across the entire frequency spectrum; and means for plotting a gain compensation curve to indicate the measure of gain compensation required by the individual wherein the stimulus associated with each makers is to be positioned by the individual on each of the loudness curves.

* * * * *

UNITED STATES PATENT AND TRADEMARK OFFICE

CERTIFICATE OF CORRECTION

PATENT NO. : 6,574,342 B1
DATED : June 3, 2003
INVENTOR(S) : Keith L. Davis et al.

It is certified that error appears in the above-identified patent and that said Letters Patent is hereby corrected as shown below:

Column 1,
Line 15, delete "A".

Column 5,
Line 8, after "interface" insert -- 10 --.

Column 10,
Line 10, replace "stimilus" with -- stimulus --.
Line 41, after "individual" insert -- , the --.
Line 51, after "corresponding" insert -- to one --.

Column 11,
Line 2, replace "generate" with -- generates --.

Column 12,
Line 3, replace "fearing" with -- hearing --.
Line 22, replace "maker" with -- marker --.

Signed and Sealed this

Twenty-third Day of December, 2003

JAMES E. ROGAN
*Director of the United States Patent and Trademark Office*